US010661561B2

(12) United States Patent
Cooke

(10) Patent No.: US 10,661,561 B2
(45) Date of Patent: May 26, 2020

(54) INKJET PRINTER

(71) Applicant: Linx Printing Technologies Ltd., St. Ives Cambridgeshire (GB)

(72) Inventor: Stephen Cooke, St. Ives Cambridgeshire (GB)

(73) Assignee: LINX PRINTING TECHNOLOGIES LTD., St. Ives Cambridges (GB)

( * ) Notice: Subject to any disclaimer, the term of this patent is extended or adjusted under 35 U.S.C. 154(b) by 0 days.

(21) Appl. No.: 16/303,456

(22) PCT Filed: May 25, 2017

(86) PCT No.: PCT/GB2017/051465
§ 371 (c)(1),
(2) Date: Nov. 20, 2018

(87) PCT Pub. No.: WO2017/212215
PCT Pub. Date: Dec. 14, 2017

(65) Prior Publication Data

US 2020/0016894 A1 Jan. 16, 2020

(30) Foreign Application Priority Data

Jun. 7, 2016 (GB) ..... 1609958.2

(51) Int. Cl.
*B41J 2/095* (2006.01)
*B41J 2/175* (2006.01)
(Continued)

(52) U.S. Cl.
CPC ..... *B41J 2/095* (2013.01); *B41J 2/08* (2013.01); *B41J 2/17596* (2013.01); *B41J 2/18* (2013.01); *B41J 2/02* (2013.01)

(58) Field of Classification Search
CPC . B41J 2/095; B41J 2/17596; B41J 2/08; B41J 2/02; B41J 2/18
See application file for complete search history.

(56) References Cited

U.S. PATENT DOCUMENTS 7,849,881 B2 * 12/2010 Lee ..... F15B 13/0839 137/884
2009/0309928 A1 * 12/2009 Goto ..... B41J 2/14072 347/47

FOREIGN PATENT DOCUMENTS

EP 2447081 5/2012
JP 2004130578 4/2004
(Continued)

*Primary Examiner* — Yaovi M Ameh
(74) *Attorney, Agent, or Firm* — Lathrop GPM LLP

(57) ABSTRACT

An electrostatic deflection inkjet printer has a main printer body separated by a vapor barrier into an electrical region and a fluid region. Electrically operated valves are provided in the fluid region. Control circuitry for deciding when to operate the valves is provided in the electrical region. Valve drive circuitry, for generating drive currents for the valves, is provided in the fluid region and is in data communication with the control circuitry via wiring, which may be a serial bus, that passes through the vapor barrier. This reduces the number of electrical connections that need to pass through the vapor barrier. A circuit carrier for the valve drive circuitry may be mounted on a valve block for the valves, and an electrically insulating material may cover the circuit carrier. The electrically insulating material may extend partially or wholly around the valve block.

13 Claims, 8 Drawing Sheets

(51) Int. Cl.

| | |
|---|---|
| ***B41J 2/08*** | (2006.01) |
| ***B41J 2/18*** | (2006.01) |
| *B41J 2/02* | (2006.01) |

(56) References Cited

FOREIGN PATENT DOCUMENTS

| | | | | | |
|---|---|---|---|---|---|
| JP | 2014156298 | * | 10/2014 | ..... | B41J 2/01 |
| WO | 2013150682 | | 10/2013 | | |
| WO | 2014156298 | | 10/2014 | | |
| WO | WO-2014-S07328 | * | 10/2014 | ..... | B41J 2/01 |

* cited by examiner

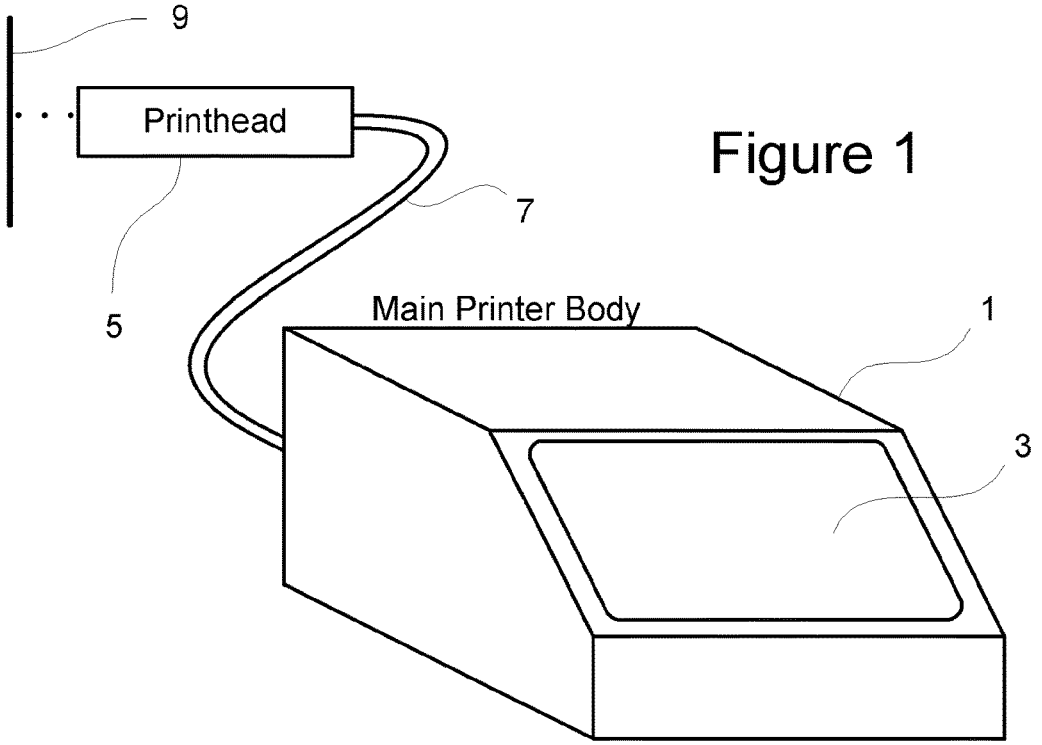
Figure 1
Figure 2
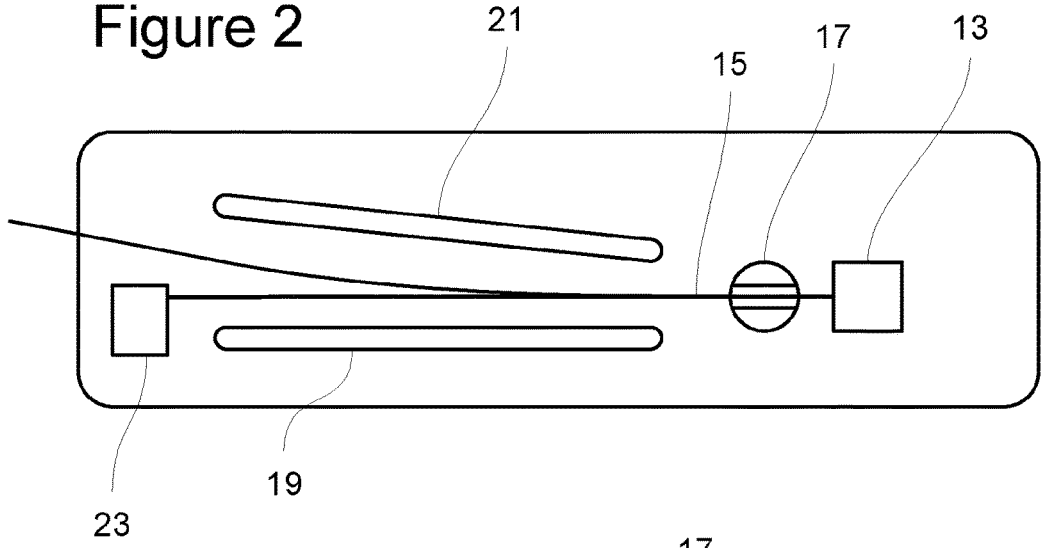
Figure 3
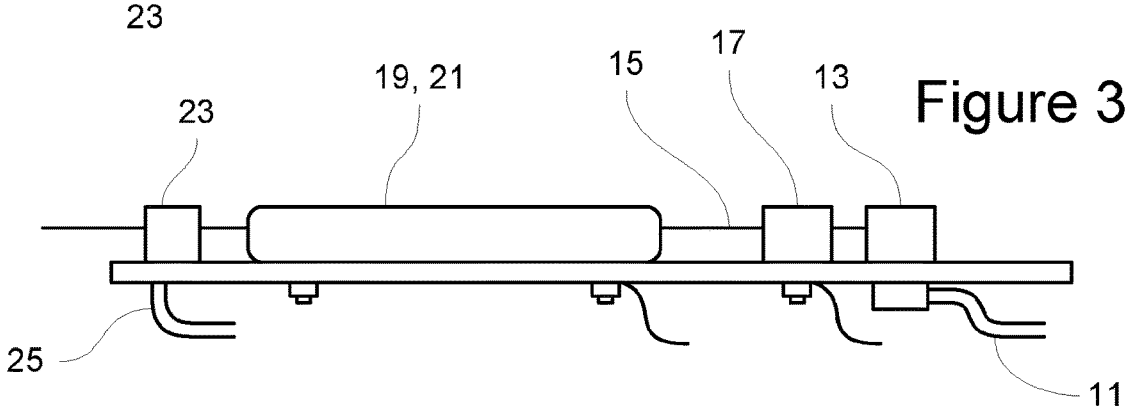

Figure 6
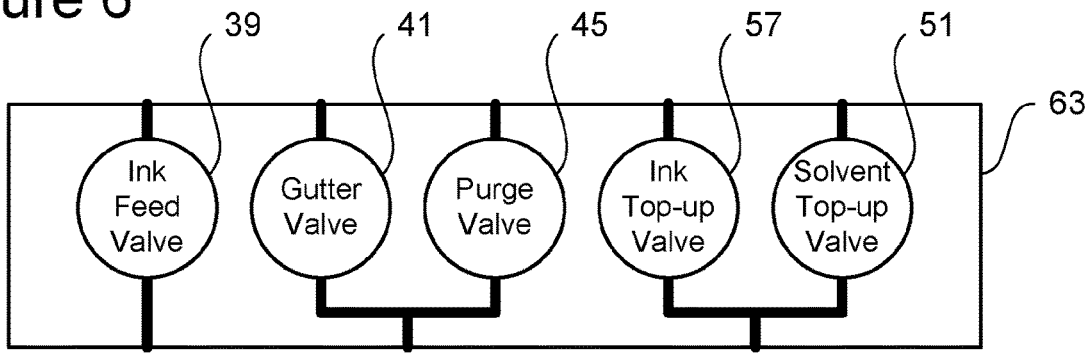
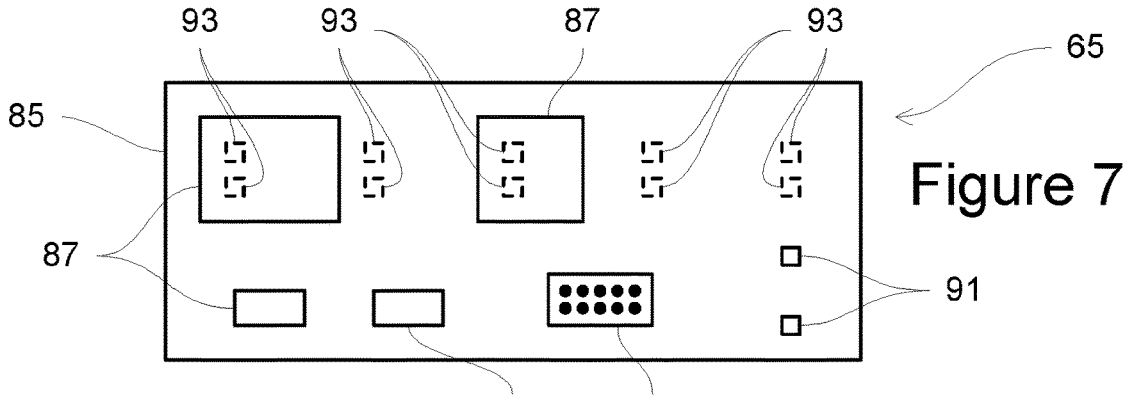
Figure 7
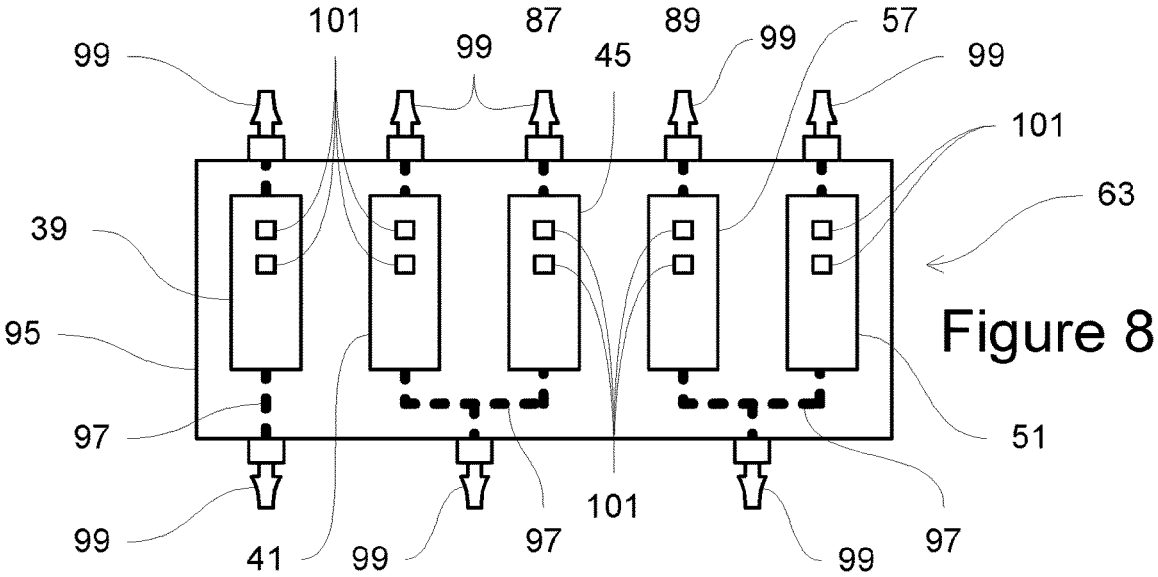
Figure 8
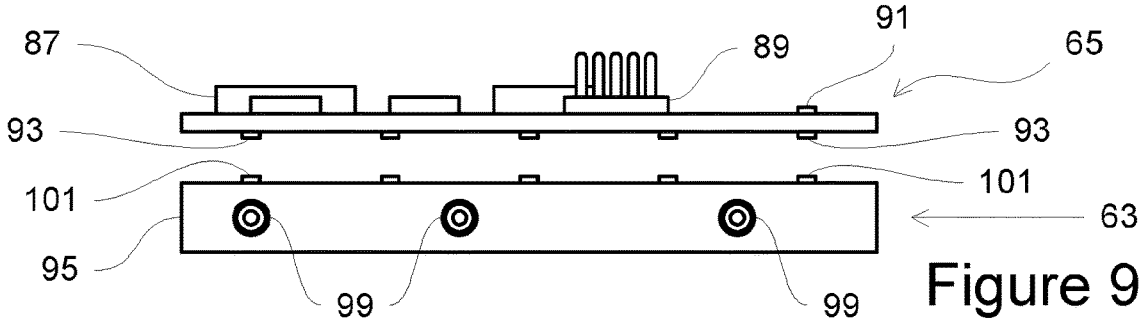
Figure 9

Figure 10
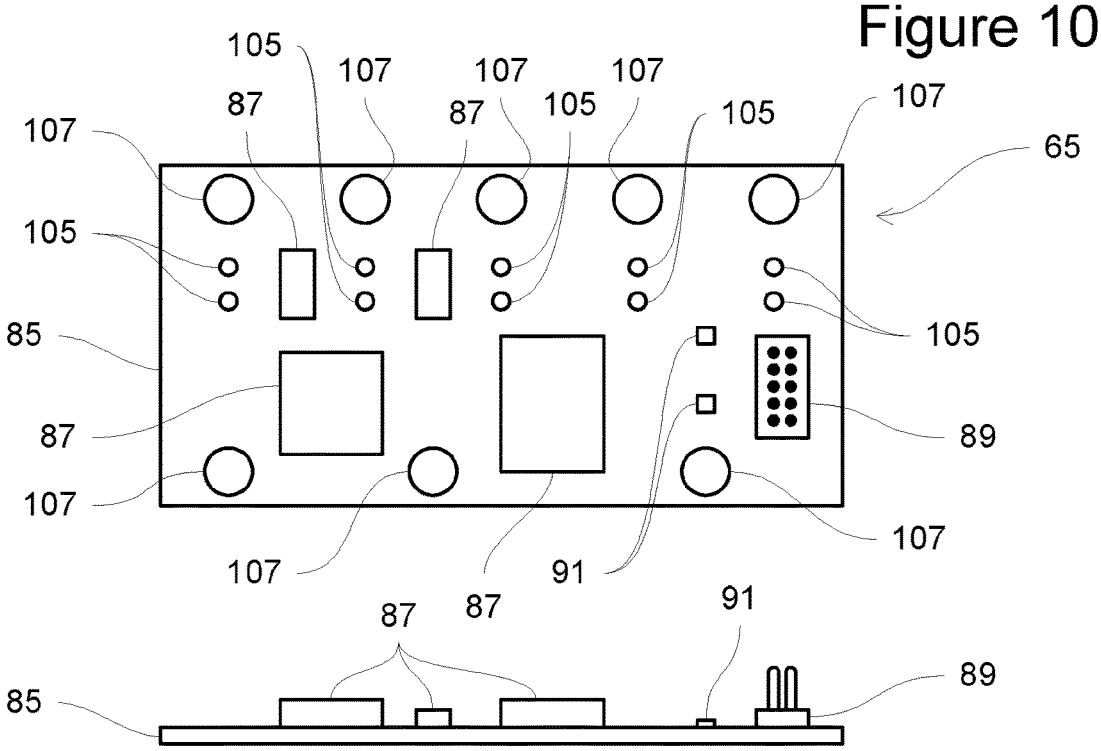
Figure 11
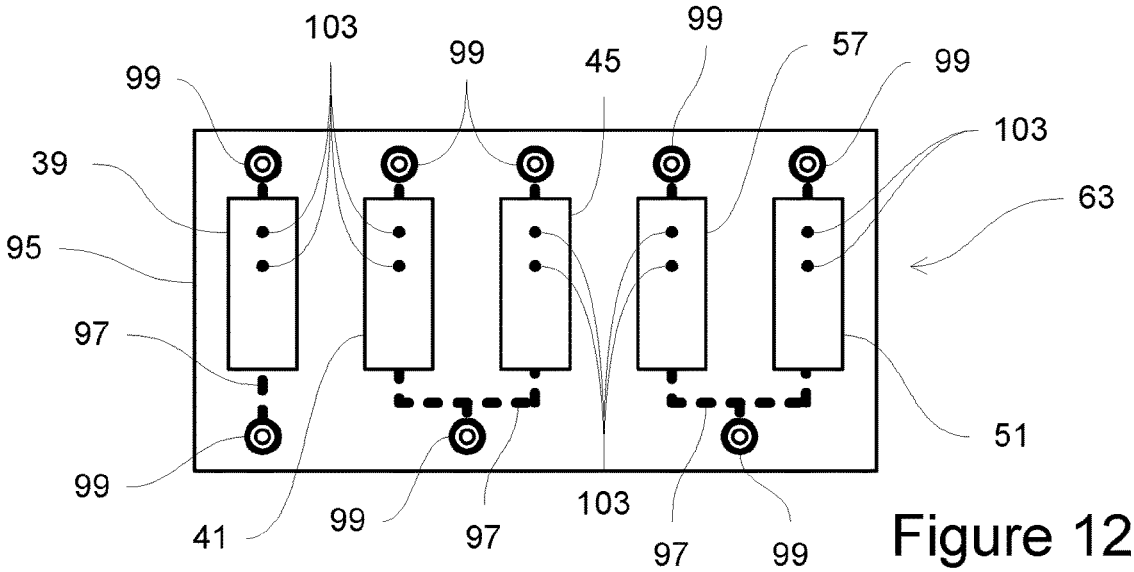
Figure 12
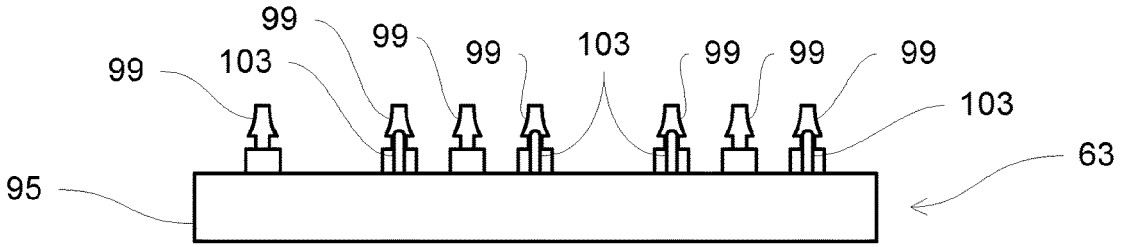
Figure 13

Figure 14
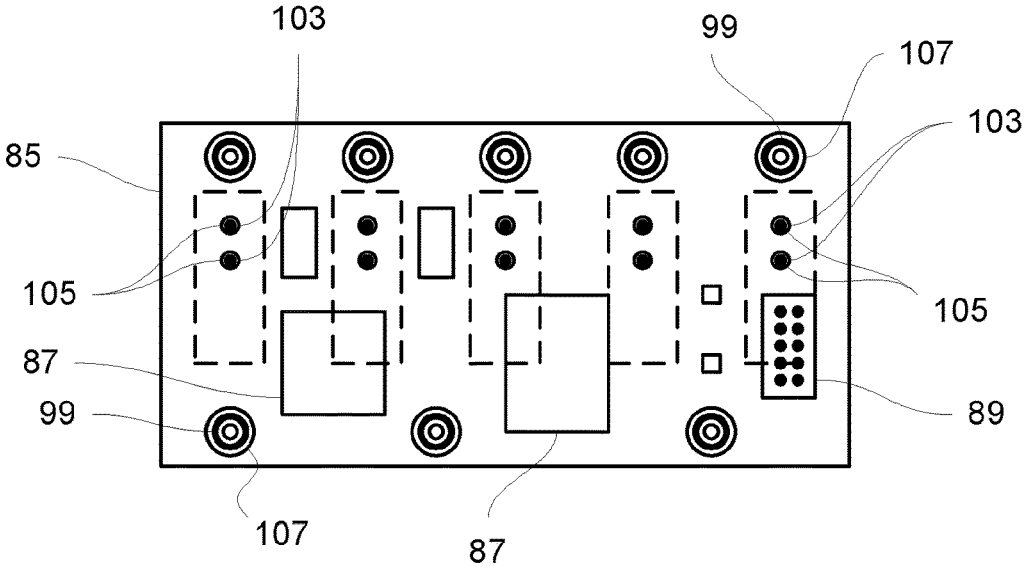
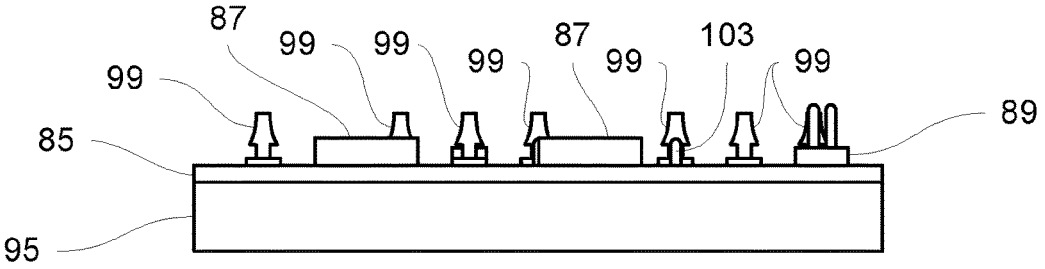
Figure 15
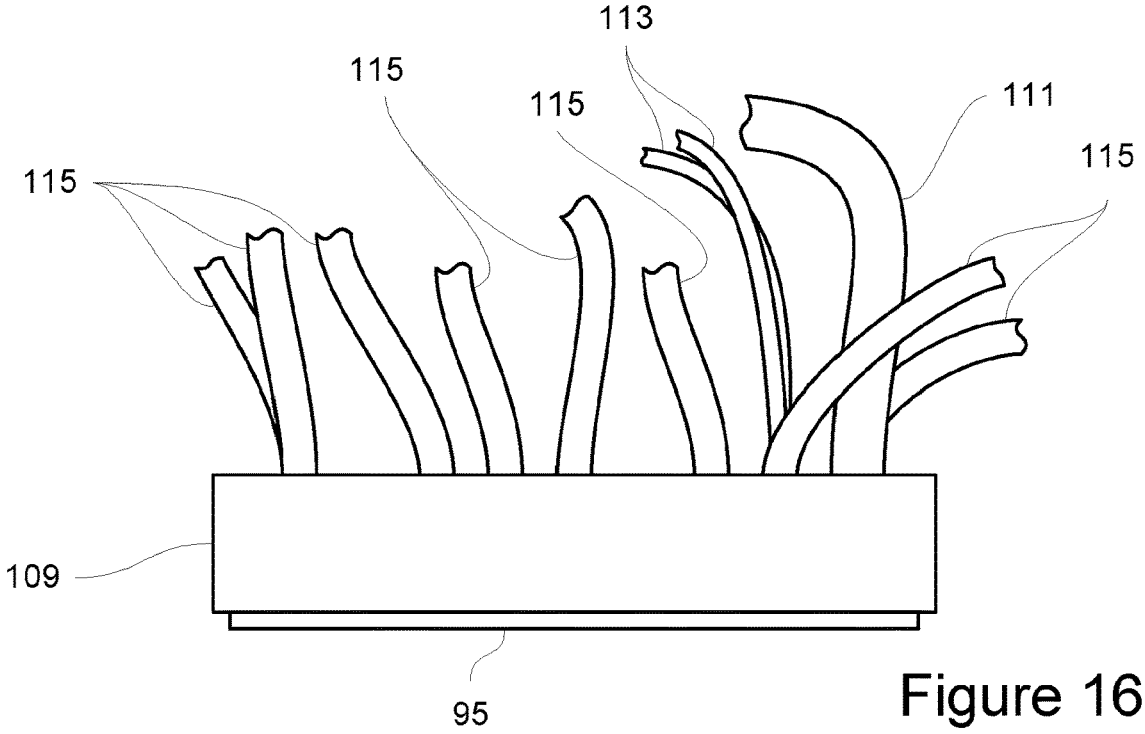
Figure 16

Figure 17
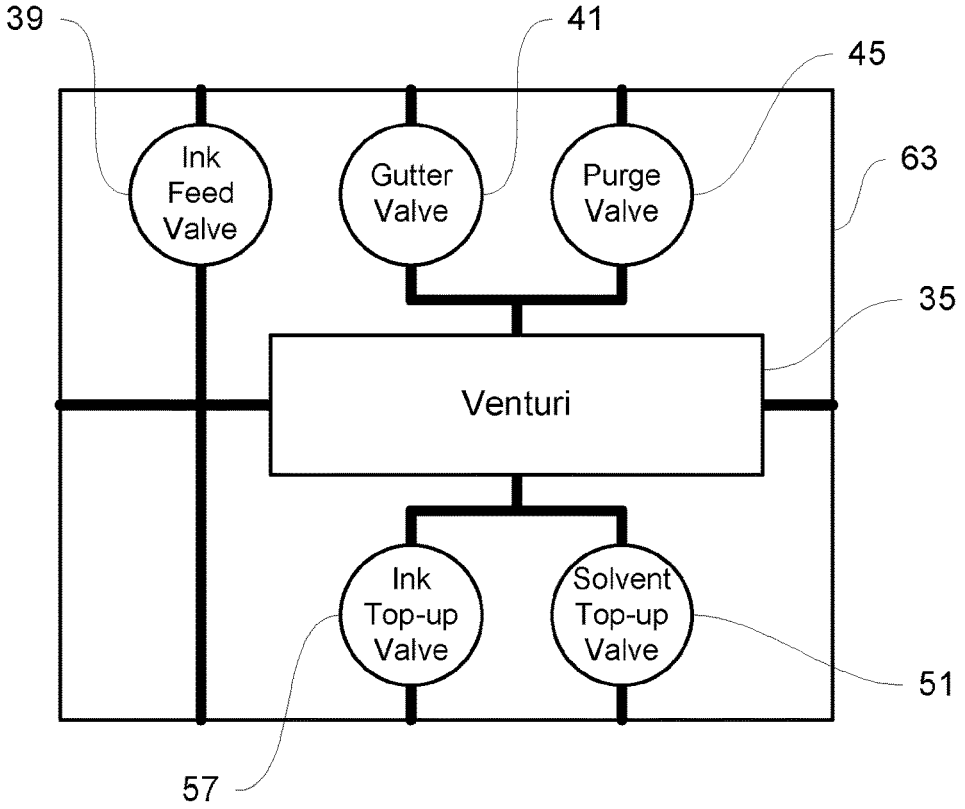
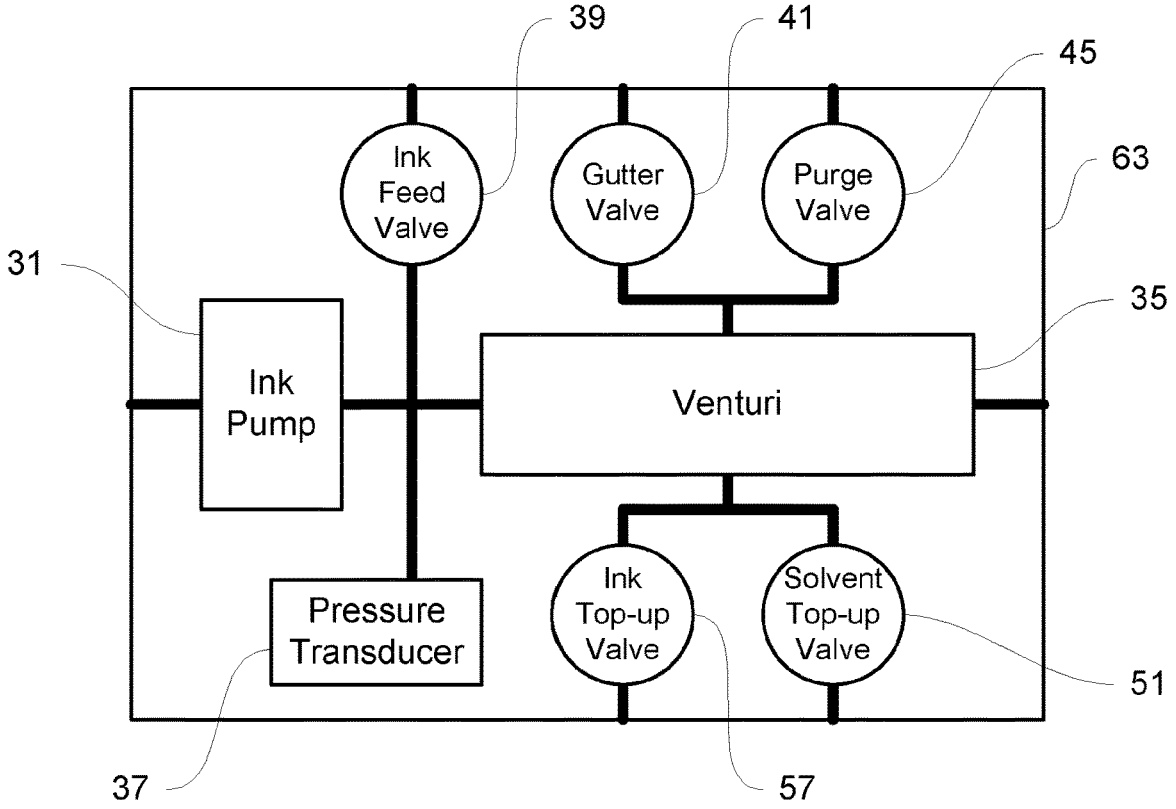
Figure 18

Figure 19
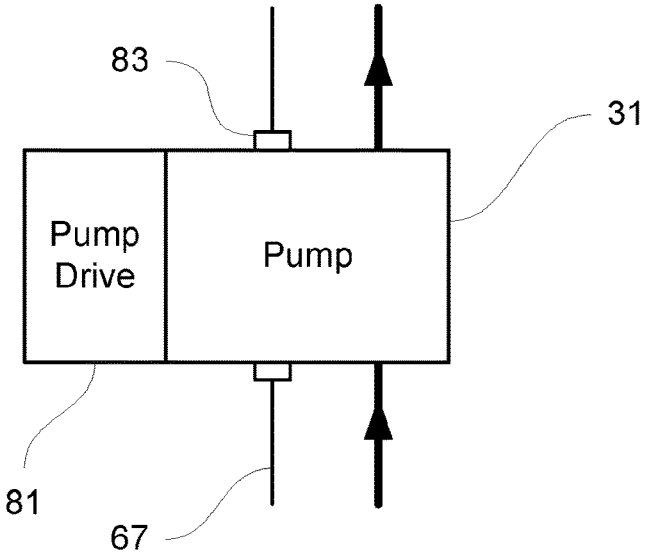
Figure 20
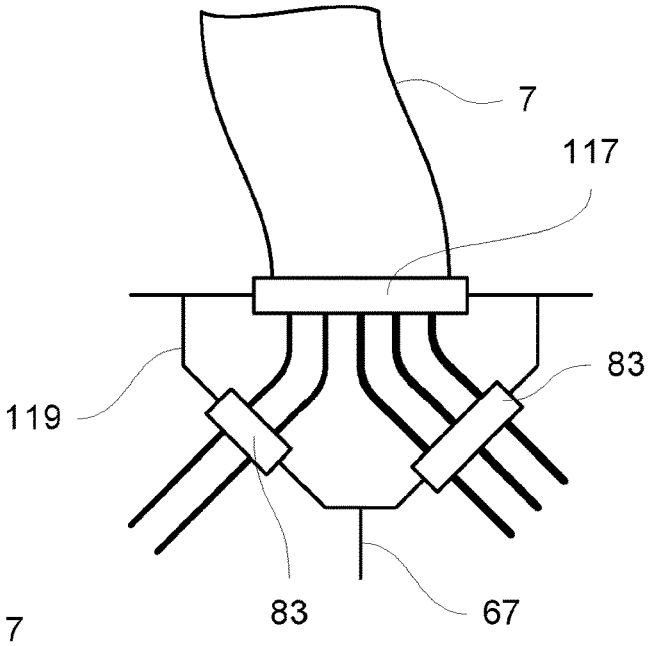
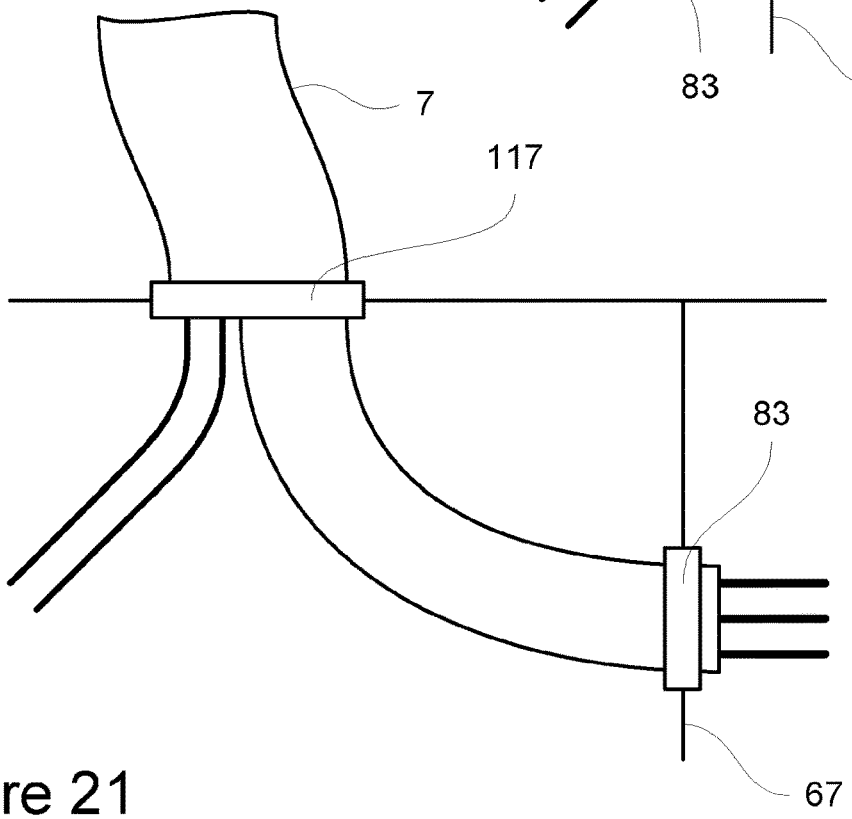
Figure 21

INKJET PRINTER

TECHNICAL FIELD

The present invention relates to an electrostatic deflection type continuous inkjet printer.

BACKGROUND

In the operation of an electrostatic deflection inkjet printer, a continuous jet of ink is formed. Electric charges are trapped on some or all of the drops of ink, and an electrostatic field deflects the drops so that the printer prints the desired printed pattern. Drops of ink which are not required for printing are caught by a gutter and are returned to an ink tank within the main body of the printer. The ink includes a solvent which is normally highly volatile so that the drops of ink dry quickly after printing. The solvent also tends to evaporate from the ink that is caught in the gutter and returned to the ink tank, so that the ink used by the printer loses solvent over time. In order to maintain the correct ink viscosity, additional solvent is added from time to time. Additionally, the ink is slowly used up as the printer prints and therefore the ink in the ink tank needs to be replenished. In order to stop and start the ink jet, and perform other operations such as adding ink and solvent and sucking air into the ink gun used to form the ink jet, and to apply or withdraw suction from the gutter, various valves are required within the ink system. The valves are normally electrically controlled and are typically solenoid valves. The ink system will also normally include other electrical components, such as an ink pump for pressurising the ink and a pressure sensor.

The solvents used for the ink are normally highly volatile. WO 2014/156298 proposes that the control components of the printer should be in a separate enclosure from the liquid circulation components so that heat generated in the control components has less effect on the liquid circulation components. The solvents are also often flammable, such as acetone and ethanol. In order to minimise the fire risk arising from solvent vapour within the main body of the printer, it is known for the main printer body to contain a vapour barrier that separates the ink system from the main electrical components. However, as noted above, the ink system itself includes the valves and other electrical components and these need to be connected to the main electrical system in order to operate. The electrical components in the ink system may need to be double-insulated for safety, and the wiring connecting these components to the main electrical system has to pass through the vapour barrier. The portion of each wire that is on the ink system side of the vapour barrier may also need to be double insulated for safety. These double insulated wires tend to be thicker than normally insulated wires and are also stiffer. This makes it difficult to work with these wires when assembling the printer and they cannot necessarily bend as sharply as normal wires when they are routed from the vapour barrier to the place where they are connected to the relevant component in the ink system.

SUMMARY

An aspect of the present invention proposes to separate control circuitry, for deciding when a valve should be operated, from valve drive circuitry that generates the electric currents that drive the valves, with the control circuitry being on the electrical circuitry side of the vapour barrier and the drive circuitry being on the ink system side of the vapour barrier.

The term "vapour barrier" is used to refer to a wall or other separator that significantly restricts the movement of vapour from one side of it to the other. Preferably the vapour barrier prevents the movement of vapour.

Accordingly, an aspect of the present invention provides an electrostatic deflection type continuous ink jet printer having a printer body containing an ink system, an electrical control system, and a vapour barrier therebetween. The ink system includes a plurality of electrically operated valves. The control system includes circuitry for generating signals indicating when each of the valves should be operated. Drive circuitry is provided on the same side of the vapour barrier as the ink system, for generating drive currents to operate the valves in response to signals received from the control circuitry. Wiring for conveying the signals from the control circuitry to the drive circuitry passes through the vapour barrier.

In a typical embodiment, wires will need to pass through the vapour barrier to provide the electric supply used to generate the valve drive currents and also wires will be needed to power drive circuit logic and to carry signals from the control system. However, the number of wires that need to pass through the vapour barrier, and be double insulated on the ink system side of the vapour barrier, will normally be substantially less than the number of wires needed if the valve drive currents were generated on the electrical system side of the vapour barrier and separate electric drive wires for each valve had to pass through the vapour barrier. The reduction in the number of wires arises particularly if the signals from the control circuitry to the drive circuitry are carried by a serial data connection so that the number of data wires is less that the number of valves. Additionally, the drive circuitry can be designed so that all of the wires passing to it through the vapour barrier terminate at places on the drive circuitry that are relatively easy to connect the wires to during assembly, in order to mitigate the disadvantage caused by the stiffness of the wires.

Preferably the valve drive circuitry receives electric power, for generating the valve drive currents for a plurality (preferably all) of the valves in the ink system part of the main body, from a common set of power lines, to reduce the number of wires needed as compared with providing a separate power supply per valve.

Preferably at least some of the valves are contained within a common valve block, which may also include liquid connections between the valves, and the valve drive circuitry is positioned immediately adjacent this valve block. If the drive circuitry is designed so that its connection points for the valve drive currents are positioned to match the connection points on the valves for receiving those currents, the electrical connections between the valves and the drive circuitry can be very simple, and the necessary safety insulation for the drive circuitry can be provided by encasing the drive circuitry and some or all of the valve block in insulating material which may for example be a potting compound.

In one embodiment, the valves have electrical contact pads on the valve block and the drive circuitry is formed on a circuit board with electrical contact pads for the valve drive currents on a face of the circuit boards towards the valve block and at positions matching the positions of the contact pads on the valves, so that the circuit board can be placed directly on the valve block to make the necessary connections. The electrical connections can be secured for example by using electrically conductive adhesive between the pads on the valves and the pads on the circuit board for the drive circuitry.

In an alternative embodiment, the valve block has electrical contact pins (connection pins) for the valve drive currents and the valve drive circuitry is formed on a circuit board having connector holes positioned to receive the connection pins of the valve block, and the drive circuitry is laid out so that the drive currents are provided to the respective connection holes. Accordingly, in this embodiment the circuit board for the drive circuitry can be placed on the valve block so that the connection pins of the valve block pass through the connection holes of the circuit board and the connection pins can be soldiered or otherwise connected to the circuit board. Again, the required electrical insulation of the drive circuitry can be provided by encasing the drive circuitry and at least part of the valve block with an insulating material such as a potting compound.

In the case that the fluid flow paths within the printer include a direct flow path from one valve to another, with or without a branch between that direct connection and another part of the fluid flow network, the valve block can contain the connection between the valves and can also contain the flow paths between the connection and the respective valves, so that the valve block also acts as a manifold.

In addition to the valves, the valve block may contain other components of the liquid system. For example, the valve block may also contain any or all of a device for generating suction (e.g. a Venturi arranged to generate suction from the flow of ink through it), a pressure sensor for sensing the pressure of the ink and sending a signal indicating the pressure to the control circuitry, and an ink pump for pressurising the ink. If the pressure sensor is included in the valve block, its electrical connections can be made to the circuit board in the same way as discussed above for the valves. The ink pump drive current can be generated in drive circuitry on the ink system side of the vapour barrier, in response to signals that pass through the vapour barrier from the control circuitry, in a manner similar to that discussed above for the valves, and the ink pump can be connected to receive its drive current from the drive circuitry in the same way as the valves. The drive circuitry for the ink pump can be provided on the same circuit board as the drive circuitry for the valves.

In an alternative construction, the ink pump can be built into or fitted through the vapour barrier, so that a first part of the ink pump is on the electrical side of the vapour barrier and can receive electrical connections, and a second part of the ink pump is on the liquid side (ink system side) of the vapour barrier and can receive a connection with the liquid flow path.

In an aspect of the present invention an electrostatic deflection ink jet printer has a main printer body separated by a vapour barrier into an electrical region and a fluid region. Electrically operated valves are provided in the fluid region. Control circuitry for deciding when to operate the valves is provided in the electrical region. Valve drive circuitry, for generating drive currents for the valves, is provided in the fluid region and is in data communication with the control circuitry via wiring (preferably comprising a serial data bus) that passes through the vapour barrier. This reduces the number of electrical connections that need to pass through the vapour barrier. Preferably a circuit carrier for the valve drive circuitry is mounted on a valve block for the valves, and an electrically insulating material covers the circuit carrier. The electrically insulating material may extend partially or wholly around the valve block.

Further aspects and optional features of the present invention are set out in the accompanying claims.

The printer usually comprises means for deflecting the drops in flight, so that different drops can travel to different destinations. Typically, the ink is electrically conductive when wet, and the printer comprises an arrangement of electrodes to trap electric charges on the ink drops and create electrostatic fields in order to deflect the charged drops.

Normally, the inkjet printer has a print head that is separate from the main printer body and is connected to the main printer body by a flexible connector sometimes known as a conduit or umbilical that carries fluid and electrical connections between the print head and the main printer body. The print head includes an ink gun that receives pressurised ink and allows it to exit through an orifice to form a jet of ink, a charge electrode for trapping electric charges on drops of ink, deflection electrodes for creating an electrostatic field for deflecting charged drops of ink, and a gutter for collecting drops of ink that are not used for printing. The umbilical will include fluid lines for providing pressurised ink to the ink gun and for applying suction to the gutter and transporting ink from the gutter back to the main printer body. Often it will include other fluid lines such as a purge line allowing suction to be applied to the ink gun if required to suck air in through the jet-forming orifice to remove a blockage or to empty the ink gun of ink, and a flush line for delivering solvent to the ink gun. Electrical connections may be provided, for example to drive a piezoelectric crystal or the like for imposing pressure vibrations on the ink jet in order to control the way in which the jet breaks into drops, electrical connections for the charge electrode and the deflection electrodes, and also drive currents for any valves that may be included in the print head. Accordingly, the umbilical carries both electrical connections and fluid connections.

There are various options for connecting the umbilical to the main printer body. For example, the umbilical may split to connect the fluid lines to the printer body at a first location, on the ink side of the vapour barrier, and to connect the electrical lines to a second location on the electrical side of the vapour barrier. Alternatively, the umbilical may connect to a third region within the main printer body, that is separated by a vapour barrier from both the electrical region and the ink region, with the electrical connections passing through the vapour barrier into the electrical region and the fluid paths parting through the vapour barrier into the ink region. In a further alternative, the umbilical is connected to the main printer body on one side or the other of the vapour barrier that separates the electrical region from the ink region, and either the electrical lines or the fluid lines (whichever is in the wrong region) then has to pass through the vapour barrier in the main printer body. In this case, the lines between the umbilical and the vapour barrier will require additional protection (double insulation if they are electrical lines or an extra vapour-proof layer in the case of fluid lines) for safety.

BRIEF DESCRIPTION OF THE DRAWINGS

Embodiments of the present invention, given by way of non-limiting example, will now be described as reference to the accompanying drawings.

FIG. 1 shows an ink jet printer embodying the present invention.

FIG. 2 is a schematic top view of the print head of the printer of FIG. 1.

FIG. 3 is a schematic side view of the print head of the printer of FIG. 1.

FIG. 6 shows a schematic layout of a simple valve block in the main body of the printer of FIG. 1.

FIG. 7 is a simplified top view of a valve drive system in the main body of the printer of FIG. 1.

FIG. 8 is a simplified top view of a valve block using the layout of FIG. 6.

FIG. 9 is a side view of the valve drive system of FIG. 7 and the valve block of FIG. 9 in position for assembly together.

FIG. 10 is a simplified top view of an alternative valve drive system in the main body of the printer of FIG. 1.

FIG. 11 is a simplified side view of the valve drive system of FIG. 10.

FIG. 12 is a simplified top view of an alternative valve block, for use with the valve drive system of FIGS. 10 and 11.

FIG. 13 is a simplified side view of the valve block of FIG. 12.

FIG. 14 is a top view of the valve drive system of FIGS. 10 and 11 and the valve block of FIGS. 12 and 13 assembled together.

FIG. 15 is a side view of the valve drive system of FIGS. 10 and 11 and the valve block of FIGS. 12 and 13 assembled together.

FIG. 16 shows the assembly of FIGS. 14 and 15 with electrical and fluid lines connected and after the application of an electrically insulating material.

FIG. 17 shows a schematic layout of an alternative valve block arrangement.

FIG. 18 shows a schematic layout of a further alternative valve block arrangement.

FIG. 19 shows an alternative arrangement for mounting the ink pump.

FIG. 20 shows a first arrangement for connecting the umbilical to the main printer body.

FIG. 21 shows a second arrangement for connecting the umbilical to the main printer body.

DETAILED DESCRIPTION

Figure 4:
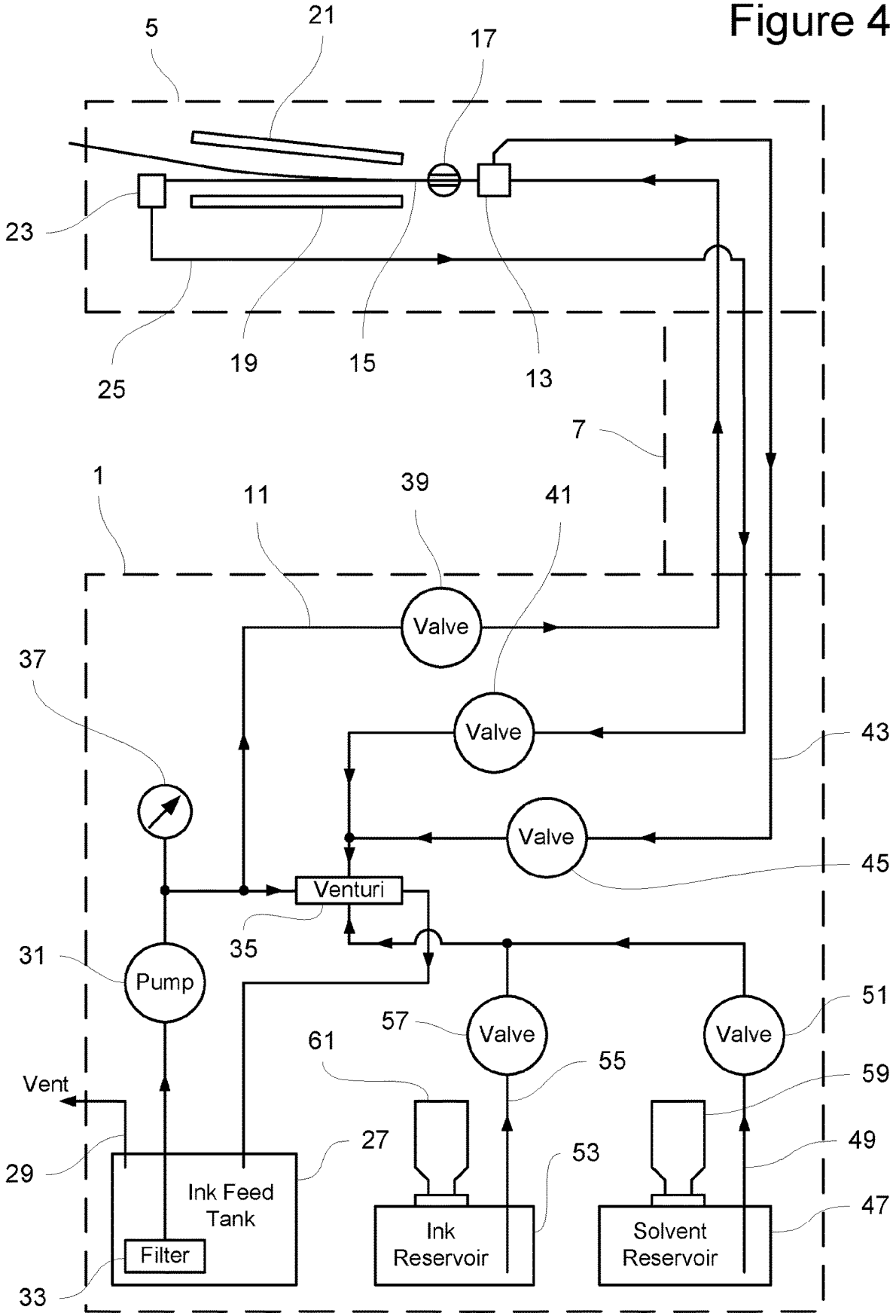
FIG. 4 shows simplified schematic diagram of the ink circuit (fluid circuit) of the printer of FIG. 1.

FIG. 1 shows an electrostatic deflection type continuous inkjet printer. The printer forms a continuous jet of ink and has an arrangement of electrodes for charging drops of ink and deflecting the drops electrostatically in order to print a desired pattern. The main fluid and electrical components are housed within a main printer body 1. An operator communicates with the printer via a touchscreen display 3. The ink jet is formed within a print head 5, which also includes the electrode arrangement for charging and deflecting the ink drops, and the print head 5 is connected to the main printer body 1 by a flexible connection 7 known as a conduit or an umbilical. Drops of ink, deflected as necessary to create the desired pattern, travel from the print head 5 and strike the surface 9 of an object conveyed past the print head 5, in order to print the desired pattern on the surface 9 of the object.

FIG. 2 is a schematic top view and FIG. 3 is a schematic side view of the main components of the print head 5. Pressurised ink, delivered from the main printer body 1 through the umbilical 7, is provided via an ink feed line 11 to an ink gun 13. The pressurised ink leaves the ink gun 13 through a small jet-forming orifice to form an ink jet 15. Provided that pressurised ink is received by the ink gun 13 and any valves in the ink gun 13 are in the appropriate state, the ink jet 15 is formed continuously. Accordingly, this type of ink jet printer is known as a continuous ink jet printer, by contrast with a drop-on-demand printer in which a drop of ink is ejected only when a dot is to be printed.

Although the ink jet 15 leaves the ink gun 13 as a continuous unbroken stream of ink, it rapidly breaks into separate drops. The path of the ink jet passes through a slot in a charge electrode 17, which is positioned so that the ink jet 15 separates into drops while it is in the slot through the charge electrode 17. The ink is electrically conductive and the ink gun 13 is held at a constant voltage (typically ground). Accordingly, any voltage applied to the charge electrode 17 induces a charge into the part of the ink jet 15 that is in the slot of the charge electrode 17. As the ink jet 15 separates into drops, any such charge is trapped on the drops. Accordingly, the amount of charge trapped on each drop can be controlled by changing the voltage on the charge electrode 17.

The ink jet 15 then passes between two deflection electrodes 19, 21. A large potential difference (typically several kilovolts) is applied between those electrodes 19, 21 to provide a strong electric field between them. Accordingly, the drops of ink are deflected by the electric field and the amount of deflection depends on the amount of charge trapped on each drop. In this way, each ink drop can be steered into a selected path. As shown in FIG. 2, uncharged ink drops, which pass through the electric field without deflection, travel to a gutter 23 where they are caught. Suction is applied to the inside of the gutter 23 by a suction line 25, and so the ink received by the gutter 23 is sucked away and returned through the umbilical 7 to the main printer body 1, for reuse.

Drops of ink that are deflected by the field between the deflection electrodes 19, 21, so as to miss the gutter 23, leave the print head 5 and form printed dots on the surface 9 of the object.

FIG. 4 is a simplified schematic diagram of a fluid circuit for the inkjet printer of FIG. 1. Ink is held in an ink feed tank 27 in the main printer body 1. The interior of the ink feed tank 27 is held at atmospheric pressure by a vent 29. Ink is sucked out of the ink feed tank 27 by a pump 31, via a filter 33. The ink, pressurised by the pump 31, flows through a Venturi 35 and back to the ink feed tank 27. Ink will flow continuously around this loop as long as the pump 31 is running. The flow of ink through the Venturi 35 generates suction. A pressure transducer (pressure sensor) 37 is used to sense the ink pressure on the outlet side of the ink pump 31.

The ink feed line 11 is also connected to the outlet side of the ink pump 31 and receives pressurised ink. An ink feed valve 39 in the main printer body 1 controls the flow of ink through the ink feed line 11. The gutter suction line 25 returns ink from the gutter 23 through the umbilical 7 to the main printer body 1, and receives suction from the Venturi 35. Fluid flow in the gutter suction line 25 is controlled by a gutter valve 41. The Venturi 35 also provides suction to a purge line 43, which passes through the umbilical 7 to the print head 5 in order to apply suction to the interior of the ink gun 13 when required. Flow in the purge line 43 is controlled by a purge valve 45.

During operation of the printer, the solvent in the ink used to form the ink jet 15 tends to evaporate, causing a change in the viscosity of the ink. In order to restore the ink to the correct viscosity, it is necessary to add further solvent from time to time. Spare solvent is held in a solvent reservoir 47 which receives suction from the Venturi 35 through a solvent top-up line 49. In order to add solvent to the ink, a solvent top-up valve 51 in a solvent top-up line 49 is opened briefly, allowing the Venturi 35 to suck a small quantity of solvent from the solvent reservoir 47. Solvent sucked in by the Venturi 35 joins the ink flow through the Venturi and therefore passes into the ink feed tank 27, so as to dilute the ink in the ink feed tank.

As the inkjet printer prints, it will slowly use up ink from the ink feed tank 27. When the ink level becomes too low, the ink feed tank 27 is topped up from an ink reservoir 53. Ink is sucked out of the ink reservoir 53 by the Venturi 35 via an ink top-up line 55, controlled by an ink top-up valve 57, in a similar manner to the operation for topping up with solvent from the solvent reservoir 47. The solvent reservoir 47 and the ink reservoir 53 are supplied from a solvent bottle 59 and an ink bottle 61 respectively, and the operator replaces the bottles 59, 61 as necessary.

Figure 5:
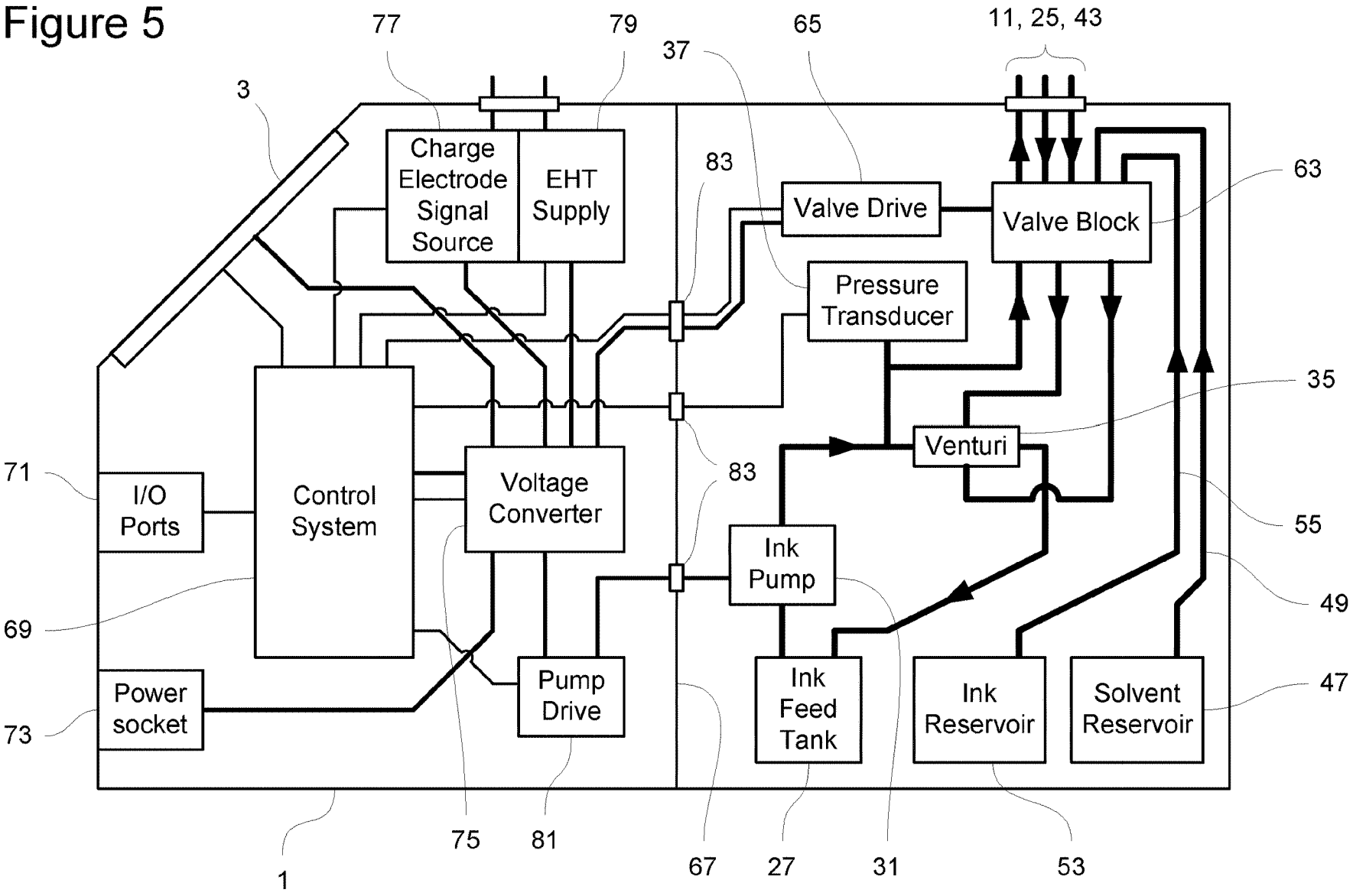
FIG. 5 shows the main components inside the main body of the printer of FIG. 1.

FIG. 5 shows schematically the main components inside the main printer body 1. The ink feed valve 39, the gutter valve 41, the purge valve 45, the solvent top-up valve 51 and the ink top-up valve 57, shown in FIG. 4, are all contained in a valve block 63. A valve drive system 65 generates the electric currents used to actuate the valves in the valve block 63. Although a single line is shown in FIG. 5 between the valve drive system 65 and the valve block 63, there will normally in practice be two connections between the valve drive system 65 and each individual valve in the valve block 63, to enable current to flow through the respective valve in order to operate it.

The valve block 63, the valve drive system 65 and the other parts of the ink circuit including the ink feed tank 27, the ink pump 31, the Venturi 35, the pressure transducer 37, the solvent reservoir 47 and the ink reservoir 53 are all contained in a portion of the main printer body 1, known as the ink portion or fluid portion, which is separated by a vapour barrier 67 from an electrical or control portion. This is a safety precaution in order to reduce the risk of heat or a spark in the electrical system igniting flammable ink vapour within the main printer body 1. As a safety precaution, all electrical lines within the ink portion of the main ink body 1 are double insulated. In FIG. 5, the ink portion is shown to the right of the vapour barrier 67 and the electrical portion is shown to the left of the vapour barrier 67.

The operation of the ink jet printer is controlled by a control system 69 in the electrical portion of the main printer body 1. The control system 69 controls the touchscreen display 3 and receives operator inputs from it. It is also connected input/output ports 71, such as a USB port or an Ethernet port. The ports 71 allow the printer to be connected to other devices such as a shaft encoder and a photocell, for receiving information about objects being conveyed past the print head 5 to be printed onto. It also allows the control system to read in data from another device, such a library of messages to be printed, and allows software and firmware within the control system 69 to be updated.

The printer receives electric power at a power socket 73, which is converted in a voltage converter 75 to the various voltages required internally within the printer. For example, the printer may be designed to receive 24 volt DC at the power socket 73, since power supplies for generating 24 volts DC from an electric mains supply are widely available.

The voltage converter 75 uses the received 24 volt supply to generate the voltages required to power the electronics and control system 69, which may for example be 5 volts. It also supplies power to a charge electrode signal source 77 and an EHT supply 79. The charge electrode signal source operates under control of the control system 69 to generate the voltage to be applied to the charge electrode 17 in the print head 5. The EHT supply 79 generates the very high electrical voltage required by the deflection electrodes 19, 21. The voltage converter 75 also supplies power to the valve drive system 65 and a pump drive system 81. The pump drive system 81 generates the drive current for the ink pump 31 under the control of the control system 69. The voltage converter 75 may supply both a low voltage such as 5 volts, for powering electronics, and a higher voltage for generating drive currents, to the valve drive system 65 and the pump drive system 81.

The electrical system shown in FIG. 5 is highly simplified, and in practice there will be many other components such as a system to generate the voltage applied to the piezoelectric transducer in the ink gun 13, and circuitry for generating valve drive currents to be supplied via the umbilical 7 to any valves in the print head 5.

Since the valve block 63, the pressure transducer 37 and the ink pump 31 are parts of the ink system, and have to be in the fluid portion of the main printer body 1, but these items also require electrical connections, there are inevitably some electrical wires passing through the vapour barrier 67. Where the wires pass through the vapour barrier 67, it is necessary to provide a vapour-tight seal. This seal is provided in FIG. 5 by three grommets 83 shown in the vapour barrier 67. All electrical wires within the ink portion (fluid portion) of the main printer body 1 are double insulated for safety. This makes the wires thicker and also stiffer than the wires would otherwise be, making them inconvenient to handle during assembly of the main printer body 1. In the simplified ink circuit shown in FIG. 4, there are five valves. However in practice a modern electrostatic deflection continuous ink jet printer is likely to contain substantially more valves than this in the main printer body, to allow additional functions to be provided such as a dedicated solvent flush line through the umbilical 7 to the ink gun 13 in the print head 5. If the drive currents for the valves are generated in the electrical portion of the main printer body 1 (to the left of the vapour barrier 67 as shown in FIG. 5), two electric wires to carry the drive current must pass through the vapour barrier 67 for each valve in the ink circuit, and as the number of valves in the ink circuit increases this can lead to a considerable number of wires needing to pass through the vapour barrier 67 without permitting any breach in the vapour barrier, and a corresponding number of stiff and awkward double insulated wires within the ink portion.

Accordingly, the valve drive current is generated in the valve drive system 65, which is placed in the fluid portion of the main printer body 1. The valve drive system 65 needs to receive power connections to the voltage converter 75, both to drive its internal circuitry and to provide power for the valve drive currents. Additionally, the valve drive 65 needs to be in data communication with the control system 69 so that the control system can control when each valve is actuated. However, the number of power connections to the valve drive system 65 does not need to increase as the number of valves increases. The amount of data communication between the valve drive system 65 and the control system 69 will increase with an increase in the number of valves, but this does not necessarily require a corresponding increase in the number of electrical connections between the valve drive system 65 and the control system 69. For example, the data communication can be carried by a serial bus system enabling data relating to multiple valves to be carried on a single set of data bus lines. Accordingly, although some electric wiring is required between the control system 69 and the valve drive system 65, the number of wires that have to pass through the vapour barrier 67 can be reduced by placing the valve drive system 65 in the ink portion of the main printer body 1 rather than placing it in the electrical portion.

Even though the valve drive system 65 is in the ink portion (fluid portion) of the main printer body 1, it is still necessary for electrical connections to be made between the valve drive system 65 and the individual valves in the valve block 63 to enable the valve drive currents to reach the valves. Any wires used to carry the valve drive currents between the valve drive system 65 and the valve block 63 will need to be double insulated and therefore will be stiff and awkward to handle. However, because such wires do not pass through the vapour barrier 67 it is possible to make the electrical connections between the valve drive system 65 and the valve block 63 before these components are placed in the main printer body 1, rather than having to make the electrical connections to the valve block 63 as part of the final assembly after components have been placed in the main printer body 1. Therefore, these connections can be formed while access to the components is relatively easy and in this way the manufacturing process is more convenient.

Furthermore, as will be described with reference to FIGS. 7 to 15, it is possible to design the valve drive system 65 and the valve block 63 so that the electrical connections between them can be direct connections that do not require any intervening wires, which further increases the convenience in this manufacturing step.

FIG. 6 shows schematically the layout of a simple valve block 63 that includes the five valves 39, 41, 45, 51, 57 shown in FIG. 4. The valve block 63 of FIG. 6 includes internal flow paths that provide connections between the gutter valve 41 and a purge valve 43 and between the solvent top-up valve 51 and the ink top-up valve 57. By providing these flow path junctions within the valve block 63, so that the valve block 63 also acts as a manifold, the number of fluid flow lines that need to be connected to the valve block is reduced.

FIG. 7 is a simplified top view of the valve drive system 65 in a first embodiment, and FIG. 8 is a simplified top view of the valve block 63 in the first embodiment. The valve block 63 in FIG. 8 has five valves following the layout scheme shown in FIG. 6. FIG. 9 is a side view showing the valve drive system 65 of FIG. 7 and the valve block 63 of FIG. 8 aligned with each other and ready to be joined to each other.

The valve drive system 65 shown in FIG. 7 comprises a circuit carrier for carrying the valve drive circuitry. In the illustrated embodiment, this carrier is a circuit board 85 (preferably a printed circuit board or PCB). The valve drive circuitry includes various circuit components 87, which may be integrated circuits, provided on the upper surface of the circuit board 85. Additionally, a data bus connection header 89 and electric power connector pads 91 are also provided on the top surface on the circuit board 85. The data bus connection header 89 allows a matching data bus connection socket to be pushed onto it to provide electrical connections between a data bus and the circuit components 87 of the valve drive system 65. The data bus includes the wiring necessary to provide the data connection between the valve drive system 65 and the control system 69. For example, it may include lines for Serial Data In, Serial Data Out, Frame Clock and Bit Clock. It also includes low voltage power lines so as to provide power to the logic circuitry of the valve drive system 65. All the wires in the data bus are enclosed in a common outer sheath, which provides the required double-insulation. By enclosing multiple wires in a single outer sheath, it is possible to reduce the number of separate cables that need to be handled. The separate electric power connector pads 91 enable the valve drive system 65 to be connected (e.g. by soldering) to wires providing the electric current required to drive the valves, possibly at a higher voltage than the electric supply to the logic circuits. The circuitry of the valve drive system 65 is laid out so that the valve drive currents are provided to valve drive connector pads 93, which are provided on the underside of the circuit board 85.

The valve block 63 of FIG. 8 comprises a solid main body 95, into which the valves 39, 41, 45, 51, 57 are fitted. Channels 97 (shown in broken lines in FIG. 8) are formed within the main body 95 to provide the fluid flow paths for the valves. Each channel 97 terminates at a connector spike 99 to enable connection to flexible piping that provides the fluid paths between components within the fluid system portion of the main printer body 1. On the top of each valve there are valve drive connector pads 101 for receiving valve drive currents from the valve drive system 65.

The valve drive connector pads 93 on the valve drive system 65 and the valve drive connector pads 101 on the valve block 63 have matching positions, and the valve drive connector pads 93 on the valve drive system 65 are formed on the underside of the circuit board 85 whereas the valve drive connector pads 101 of the valve block 65 are provided on the upper side of the valve block 63. Accordingly, as can been seen in FIG. 9, if the valve drive system 65 is positioned immediately above the valve block 63, the two sets of connector pads 93, 101 face each other. The valve block 63 and the valve drive system 65 can then be assembled together, so that the valve drive connector pads 93 and the valve drive connector pads 101 contact each other, enabling transmission of the valve drive currents directly from the valve drive system 65 to the valves fitted into the valve block 63. In order to secure the valve drive connector pads 93, 101 to each other and ensure good electrical connection, an electrically conductive adhesive may be used between them.

During assembly of the main printer body 1, the circuit board 85 is mounted on the valve block 63 to provide the electrical connections to the valves. Then the data bus is connected to the valve drive system 65 by pushing the data bus socket onto the data bus connection header 89, and additionally the separate power connection wires are joined (e.g. soldered) to the electric power connector pads 91. Subsequently, the valve drive system 65 is covered in an electrically insulating material such as a potting compound, which also extends around at least a part of the main body 95 of the valve block 63 so that the electrically insulating material and the valve block 63 jointly encase the valve drive system 65. Consequently, the valve drive system (including the valve drive connector pads 93) and also the valve drive connector pads 101 of the valve block 63 are fully insulated electrically, provided that the valve block 63 provides electrical insulation. The electrically insulating material can also extend fully around the valve block as well if desired, which will provide complete electrical insulation even if the valve block 63 does not provide electrical insulation.

The electrical insulating material provides the required safety insulation for the valve drive system 65 and its electrical connections to other components. Additionally, the electrically insulating material provides a vapour-tight seal around the valve drive system 65, so that flammable solvent vapour cannot reach the electrical components of the valve drive system 65. Because the insulating material encases the data bus connection to the header 89 and encases the connections between power wires and the electrical power connector pads 91, it may also provide the electrical connections with some protection against physical movement.

If desired, the flexible fluid tubing can be connected to the fluid line connector spikes 99 of the valve block 63 before the electrically insulating material is provided around the valve block 63, in which case the electrically insulating material can also encase the connections between the tubing and the connector spikes 99, thereby providing mechanical support to the connections and also providing some containment if any leakage of fluid (ink or solvent) occurs where the tubing is fitted onto the connector spikes. Alternatively the electrically insulating material can be arranged so as not to encase the locations of the connector spikes 99 on the valve block main body 95, or the connector spikes 99 may be made sufficiently large that they extend out through the electrically insulating material. This allows the flexible tubing for the fluid paths to be fitted to the connector spikes 99 after the valve drive system 65 is encased in the electrically insulating material, and consequently allows the tubing to be removed and replaced during a maintenance operation for the printer. However, in this case the casing of electrically insulating material will not provide mechanical support for the connection between the flexible tubing and the connector spikes 99.

FIG. 10 is a simplified top view of the valve drive 65 in a second embodiment and FIG. 11 is a side view of the valve drive system 65 FIG. 10. FIG. 12 is a simplified top view of the valve block 63 in the second embodiment, and FIG. 13 is a simplified side view of the valve block 63 of FIG. 12. In this embodiment, the valve drive connector pads 93, 101 are not used. Each of the valves 39, 41, 45, 51, 57 has connector pins 103 in place of the valve drive connector pads 101. The valve drive system 65 has valve drive connector holes 105, which pass through the circuit board 85, in place of the valve drive connector pads 93. The valve drive system 65 is arranged so that the valve drive currents are connected to the valve drive connector holes 105, and the valve drive connector holes 105 are provided in positions that match the positions of the valve drive connector pins 103 of the valve block 63.

Additionally, the connector spikes 99, for connection to flexible piping that provides the fluid paths between components of the fluid system, are provided in FIGS. 12 and 13 so that they extend upwardly in the same direction as the valve drive connector pins 103, rather than extending out sideways from the valve block main body 95 as in FIG. 8. As shown in FIG. 10, the circuit board 85 of the valve drive system 65 has holes 107 at positions matching the connector spikes 99. Because the holes 107 for the connector spikes 99 and the valve drive connector 105 pass through the circuit board 85, it is necessary to arrange the other parts of the valve drive system, such as circuit components 87, the data bus connection header 89 and the electric power connector pads 91 so as not to interfere with the holes.

When the valve drive system 65 and the valve block 63 are assembled together, the valve drive connector pins 103 of the valve block 63 pass through the valve drive connector holes 105 of the valve drive system 65, and the connector spikes 99 for the flexible piping pass through the holes 107 of the valve drive system 65. Preferably, the circuit board 85 is able to sit directly on the main body 95 of the valve block 63. FIG. 14 is a simplified top view of the valve drive system 65 and the valve block 63 in this assembled state, and FIG. 15 is a simplified side view of the valve drive system 65 and the valve block 63 in this assembled state. In FIG. 14, the individual valves 39, 41, 45, 51, 57 are hidden under the circuit board 85, and their positions are shown in broken lines. Once the valve block 63 and the valve drive system 65 have been assembled together, the valve drive connector pins 103 can be soldered to metallisation on the circuit board 85 at the valve drive connector holes 105, in order to provide an electrical connection to deliver the valve drive currents to the valves.

The embodiment of FIGS. 10 to 15 allows the electrical connections between the valve drive system 65 and the individual valves to be made very easily by soldering onto the circuit board 65. Additionally, because the valve drive connector pins 103 and the connector spikes 99 pass through respective holes in the circuit board 85, they tend to hold the valve drive system 65 in its correct position relative to the valve block 63.

After the valve block 63 and the valve drive system 65 have been assembled together, and all the necessary electric and fluid connections have been made, the valve drive system 65 can be covered in an electrically insulated material such as a potting compound in a similar manner to the embodiment of FIGS. 7 to 9. Conveniently, the insulating material can also encase the whole of the valve block 63. The insulating material should extend at least over enough of the valve block 63 to cover the join between the valve block 63 and the valve drive system 65. The electrically insulating material may also help to fix the valve block and the valve drive system to each other.

FIG. 16 shows an example of the completed assembly after the electrically insulating material has been applied. In this example, the electrically insulating material 109 covers the valve drive system 65 completely, but only covers part of the valve block 69. The serial data bus 111, the power supply wires 113 for the electric power connector pads 91, and the flexible fluid piping 115 fitted to the connector spikes 99 to provide the fluid lines, all extend through the electrically insulating material 109 to enable electrical and fluid connection to other components of the printer. It would also be possible for the electrically insulating material 109 to extend fully around the valve block 63. It would also be possible to make the connector spikes 99 for the fluid line tubing 115 long enough that they extend out of the electrically insulating material 109, allowing the tubing 115 to be fitted after the electrically insulating material has been applied.

In practice, the electrically insulating material 109 may include or be contained in a rigid casing. This allows the completed assembly to be placed in the casing and then a settable or curable liquid (potting compound) to be poured into the casing and allowed to harden to provide the electrically insulating material.

In the embodiment of FIGS. 10 to 15, both the electrical connections from the valves of the valve block 63 and the connector spikes 99 for fluid lines pass through holes in the circuit board 85. As will be understood by those skilled in the art, it is possible to use other designs in which only some of these items pass through holes in the circuit board 85. For example, the valve drive connector pins 103 may pass through the valve drive connector holes 105, but the connector spikes 99 for fluid piping may extend sideways from the main body 95 of the valve block as shown in FIG. 8, rather than extending upwards and requiring holes 107 in the circuit board 85.

In the embodiments of FIGS. 6 to 15, the valve block 63 contains only the valves 39, 41, 45, 51, 57 and the fluid connections to the valves. However, it is possible to include other components of the ink system in the valve block 63. For example, FIG. 17 shows schematically the layout of a valve block that additionally includes the Venturi 35. Accordingly, the fluid channels 97 in the valve block 63 of FIG. 17 provide the fluid flow paths between the valves and the Venturi 35. This arrangement both reduces the number of separate components in the ink system and also reduces the number of fluid connections that need to be made by piping between the components. The valve block 63 of FIG. 17 also includes a junction between channels 97 on the inlet side of the Venturi 35, so that the valve block 63 has 2 separate external connections both connected directly to the inlet of the Venturi 35. This allows separate connections between the valve block 63 and the ink pump 31 on the one hand and the pressure transducer 37 on the other hand. This avoids the need to provide the junction between the fluid flow paths in some other component outside the valve block 63.

Further components can also be included in the valve block 63 if desired. For example, either or both of the ink pump 31 and the pressure transducer 37 could be fitted into the valve block 63. FIG. 18 shows schematically a layout including both the ink pump 31 and the pressure transducer 37. Both the ink pump 31 and the pressure transducer 37 also require electrical connections, and if they are included in the valve block 63 these electrical connections can be provided through the same circuit board 85 that carries the components of the valve drive system 65. This enables the electrical connections to be made in the same way as has been described for the electrical connections between the valve drive system 65 and the valves. Other arrangements are also possible. For example, the drive circuitry for the ink pump 31 could be provided on a separate circuit board which is mounted on the valve block 63 adjacent to the circuit board 85 of the valve drive system 65.

A further alternative way of mounting the ink pump 31 is shown in FIG. 19. In this arrangement, the body of the ink pump 31 is fitted through a hole in the vapour barrier 67 so that the fluid connections for the pump 31 are on the ink system side of the vapour barrier 67 and the electrical connections for the ink pump 31 are on the control system side of the vapour barrier 67. A grommet 83 provides a vapour-tight seal between the vapour barrier 67 and the body of the ink pump 31. In this arrangement, the pump drive system 81 can be mounted directly on the ink pump 31, on the control system side of the vapour barrier 67. In this arrangement, none of the electrical connections to the ink pump 31 need to pass through the vapour barrier 67.

The umbilical 7 carries both electrical and fluid connections between the main printer body 1 and the print head 5. Accordingly, the umbilical 7 needs to make a connection with the main printer body 1 on both sides of the vapour barrier 67. FIG. 20 shows one possible arrangement, in which the umbilical 7 terminates at a connector 117 at a region of the main body 1 of the printer that is separated by a further vapour barrier 119 from both sides of the main vapour barrier 67. Electrical connections from the umbilical 7 pass through a hole in the further vapour barrier 119 directly into the part of the main printer body 1 on the control system side of the main vapour barrier 67, whereas fluid lines from the umbilical 7 pass through a separate hole in further vapour barrier 119 into the part of the main printer body 1 on the ink system side of the main vapour barrier 67. Grommets 83 provide a vapour-tight seal for each hole.

As an alternative, the connector 117 for the umbilical 7 can be on one side or the other of the vapour barrier 67, and the lines from the umbilical 7 that are consequently on the wrong side of the vapour barrier 67 are double insulated (if electrical) or double sheathed (if fluid lines) until they pass through the vapour barrier 67 to reach the correct side of it. For example, FIG. 21 shows an arrangement where the umbilical 7 connects to the main body 1 on the control system side of the vapour barrier 67, and therefore the fluid lines from the umbilical 7 are enclosed within an additional fluid and vapour-tight sheath until they have passed through the vapour barrier 67.

The embodiments discussed above and shown in the drawings are provided by way of non-limiting example, and further alternatives will be apparent to those skilled in the art. For example, although it is preferred that all of the valves in the fluid system are in the valve block 63, it is possible to provide only some of the valves in the valve block 63 and to provide one or more valves elsewhere.

The invention claimed is:

1. An electrostatic deflection continuous ink jet printer having a printer body separated internally into a first region and a second region by a vapour barrier, the printer comprising control circuitry in the first region and comprising a plurality of electrically operated fluid valves in the second region, the control circuitry including valve control circuitry for generating valve control signals for controlling the actuation of the said valves, the printer further comprising valve drive circuitry for generating valve drive currents, effective to actuate the said valves, in response to the valve control signals, the valve drive circuitry being in the second region of the printer body and receiving the valve control signals from the valve control circuitry via electric wiring that passes through the vapour barrier and the valve drive circuitry being electrically connected to the valves to provide the valve drive currents thereto.

2. A printer according to claim 1 in which the electric wiring comprises a serial data bus.

3. A printer according to claim 1 in which the valve drive circuitry is covered by an electrically insulating material that encases the electrical connections between the valve drive circuitry and the electric wiring.

4. A printer according to claim 1 in which the valve drive circuitry is provided on a circuit carrier, the valves are provided in a valve block, and the circuit carrier and the valve block are fixed to each other.

5. A printer according to claim 4 in which the circuit carrier is covered by an electrically insulating material that encases the electrical connections between the circuit carrier and the electric wiring.

6. A printer according to claim 5 in which the electrically insulating material extends at least partially around the valve block.

7. A printer according to claim 4 in which the valves or the valve block comprise electric connection pins for receiving valve drive currents from the valve drive circuitry, the electric connection pins passing through holes in the circuit carrier.

8. A printer according to claim 4 in which the valves or the valve block comprise electric connectors on the side of the valve block facing the valve drive circuitry, for receiving valve drive currents from the valve drive circuitry, the valve drive circuitry or the circuit carrier has electric connectors on the side of the circuit carrier facing the valve block, for providing valve drive currents to the valves, and the electric connectors for receiving valve drive currents and the electric connectors for providing valve drive currents have matching positions and are in contact with each other.

9. A printer according to claim 4 in which the valve block contains fluid flow paths connecting to the valves, and the valve block contains at least one junction between said fluid flow paths.

10. A printer according to claim 4 in which a Venturi or other device for generating suction is provided in the valve block.

11. A printer according to claim 4 in which an ink pressure sensor is provided in the valve block.

12. A printer according to claim 4 in which an ink pump is provided in the valve block.

13. A printer according to claim 1 in which an ink pump is provided extending through the vapour barrier.

* * * * *